US006918448B2

(12) United States Patent
Smith

(10) Patent No.: US 6,918,448 B2
(45) Date of Patent: Jul. 19, 2005

(54) GRADER

(76) Inventor: Harold Smith, P.O. Box 63, Kingdom City, MO (US) 65262

( * ) Notice: Subject to any disclaimer, the term of this patent is extended or adjusted under 35 U.S.C. 154(b) by 12 days.

(21) Appl. No.: 10/615,736

(22) Filed: Jul. 9, 2003

(65) Prior Publication Data

US 2005/0006112 A1 Jan. 13, 2005

(51) Int. Cl.[7] ..... A01B 15/00
(52) U.S. Cl. ..... 172/684.5; 37/903
(58) Field of Search ..... 172/681, 684.5, 172/695, 765, 776; 37/903

(56) References Cited

U.S. PATENT DOCUMENTS

| | | | | | |
|---|---|---|---|---|---|
| 304,737 | A | * | 9/1884 | Kirby | 172/657 |
| 634,578 | A | | 10/1899 | Kaucher | |
| 987,803 | A | * | 3/1911 | Hickok | 172/684.5 |
| 998,740 | A | | 7/1911 | Bender | |
| 1,019,153 | A | * | 3/1912 | Hughes | 172/684.5 |
| 1,047,061 | A | * | 12/1912 | Hunter | 172/684.5 |
| 1,133,877 | A | * | 3/1915 | Monroe | 172/684.5 |
| 1,143,032 | A | * | 6/1915 | Bresse | 172/684.5 |
| 1,247,416 | A | * | 11/1917 | Leak | 172/684.5 |
| 1,663,965 | A | * | 3/1928 | Aikele | 172/684.5 |
| 1,727,181 | A | | 11/1929 | Skinner | |
| 1,798,739 | A | | 3/1931 | Hoiland | |
| 2,708,799 | A | | 5/1955 | Conyers et al. | |
| 2,817,203 | A | | 12/1957 | Sievers et al. | |
| 2,902,909 | A | * | 9/1959 | Reissinger | 404/118 |
| 3,525,380 | A | * | 8/1970 | Griffin et al. | 37/403 |
| 3,926,262 | A | * | 12/1975 | Brooks | 37/219 |
| 3,942,271 | A | | 3/1976 | George | |
| 4,360,980 | A | | 11/1982 | Jarvis | |
| 4,815,542 | A | | 3/1989 | DePlazes | |
| 5,289,879 | A | * | 3/1994 | Fay et al. | 172/197 |
| 5,497,569 | A | | 3/1996 | Byman | |
| 5,918,389 | A | | 7/1999 | Hall | |
| 6,085,848 | A | | 7/2000 | Sanders | |
| 6,283,225 | B1 | | 9/2001 | Hermonson | |
| 6,315,056 | B1 | * | 11/2001 | Ransom et al. | 172/684.5 |
| 2001/0047644 | A1 | | 12/2001 | Feely | |
| 2002/0084084 | A1 | * | 7/2002 | Turner | 172/684.5 |

* cited by examiner

*Primary Examiner*—Meredith C. Petravick
(74) *Attorney, Agent, or Firm*—Bryan Cave LLP

(57) ABSTRACT

A grader for attachment to a lift unit of a material handling vehicle and adapted to spread and smooth particulate material. The grader includes a first horizontally elongate beam adapted to engage, spread and smooth the material and a second horizontally elongate beam coupled to the first horizontally elongate beam and having a length greater than the length of the first beam to further engage the material. The first and second beams each have two ground-engaging sides which correspond in orientation to each other. A linkage assembly is used to releasably attach the first beam to the lift unit of the material handling vehicle. In use, the grader is adapted to be pulled in a first direction wherein the lift unit of the material handling vehicle may engage the material first, followed by the first beam and then followed by the second beam. Thus, as the grader is pulled in the first direction the first sides of the elongate beams face the material. The grader may then be pivoted and flipped over and pulled in a second direction wherein the lift unit of the material handling vehicle may engage the material first, followed by the first beam and then followed by the second beam.

13 Claims, 8 Drawing Sheets

GRADER

FIELD OF THE INVENTION

The present invention relates generally to grading equipment and, more particularly, to a grader attachment that is removeably attached to the front end of a loader for spreading, grading, leveling and smoothing dirt, gravel, sand and the like.

BACKGROUND OF THE INVENTION

It is often necessary to spread and smooth out particulate material such as dirt, gravel, limestone and sand. One such application is in the construction of a parking lot. Conventional grading equipment typically includes a tractor or front end loader having a single blade engaging the material to be graded. Multiple passes over the material are typically required when using such conventional grading equipment and, even with multiple passes, it is difficult to successfully evenly distribute and smooth particular material, and application of hand labor may be required.

There is a need for a grader that may be used as an attachment to a material handling vehicle having a lift unit, which enables passage of the grader over particulate material or a course surface to create a smooth surface in its wake. Preferably, such a grader would be readily attachable to the material handling vehicle in a fashion to allow the grader to be flipped over so that the grader may operate while the vehicle travels in two directions.

SUMMARY OF THE INVENTION

The present invention is directed to a grader adapted to spread and smooth particulate material. The grader is preferably attached to a lift unit of a material handling vehicle, for example, to a loader bucket of a front end loader. The grader includes a first horizontally elongate beam adapted to engage, spread and smooth the material and a second horizontally elongate beam coupled to the first horizontally elongate beam and having a length greater than the length of the first beam to further engage the material. The first and second beams each have two ground-engaging sides which correspond in orientation to each other. A linkage assembly is used to releasably attach the first beam to the lift unit of the material handling vehicle. In use, the grader is adapted to be pulled in a first direction wherein the lift unit of the material handling vehicle may engage the material first, followed by the first beam and then followed by the second beam. Thus, as the grader is pulled in the first direction the first sides of the elongate beams face the material. The grader may then be pivoted and flipped over and pulled in a second direction wherein the lift unit of the material handling vehicle may engage the material first, followed by the first beam and then followed by the second beam. As the grader is pulled in the second direction the second sides of the elongate beams face the material. As the lift unit of the material handling vehicle is raised and lowered, the grader may be controllably raised and lowered, thus allowing none or any number of the ground-engaging edges of the first and second beam to engage the material. Passage of the grader over particulate material in the manner described herein has the effect of distributing, spreading, leveling and smoothing particular material such that the surface left in the wake is relatively level and flat.

BRIEF DESCRIPTION OF THE DRAWINGS

These and other features, aspects, and advantages of the present invention will become better understood with regard to the following description, appended claims, and accompanying drawings wherein:

These drawings are provided for illustrative purposes only and should not be used to unduly limit the scope of the present invention.

DETAILED DESCRIPTION OF THE INVENTION

Figure 1:
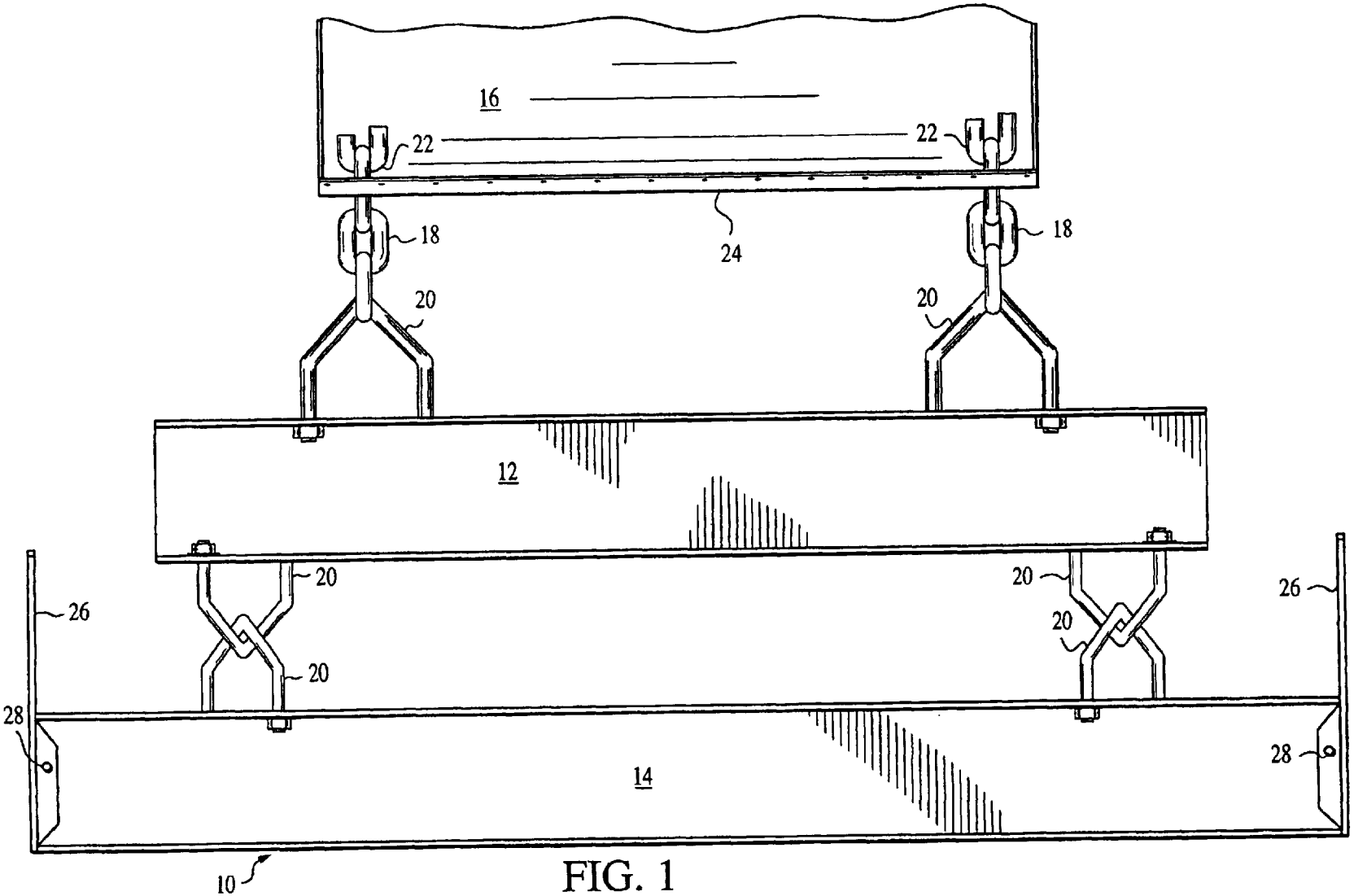
FIG. 1 is a prospective view of a grader in accordance with one embodiment of the present invention.

FIG. 1 illustrates one embodiment of a grader 10 that may be mounted on or releasably attached to a wide variety of material handling vehicles, such as a front end loader, a tractor, a bucket loader, a backhoe, a skid steer loader, a wheel dozer, a wheel loader, a scraper, and the like. Preferably, the grader 10 is attached to a lift unit 16 of the material handling vehicle, which lift unit 16 may be controllably raised and lowered, thereby controllably raising and lowering the grader 10. For example, the grader 10 may be removeably attached to the forward end of a loader bucket. The grader 10 is useful in spreading, leveling, grading and smoothing particulate material, such as dirt, gravel, sand and the like, generally by dragging the grader 10 in front of or behind the material handling vehicle.

Figure 4:
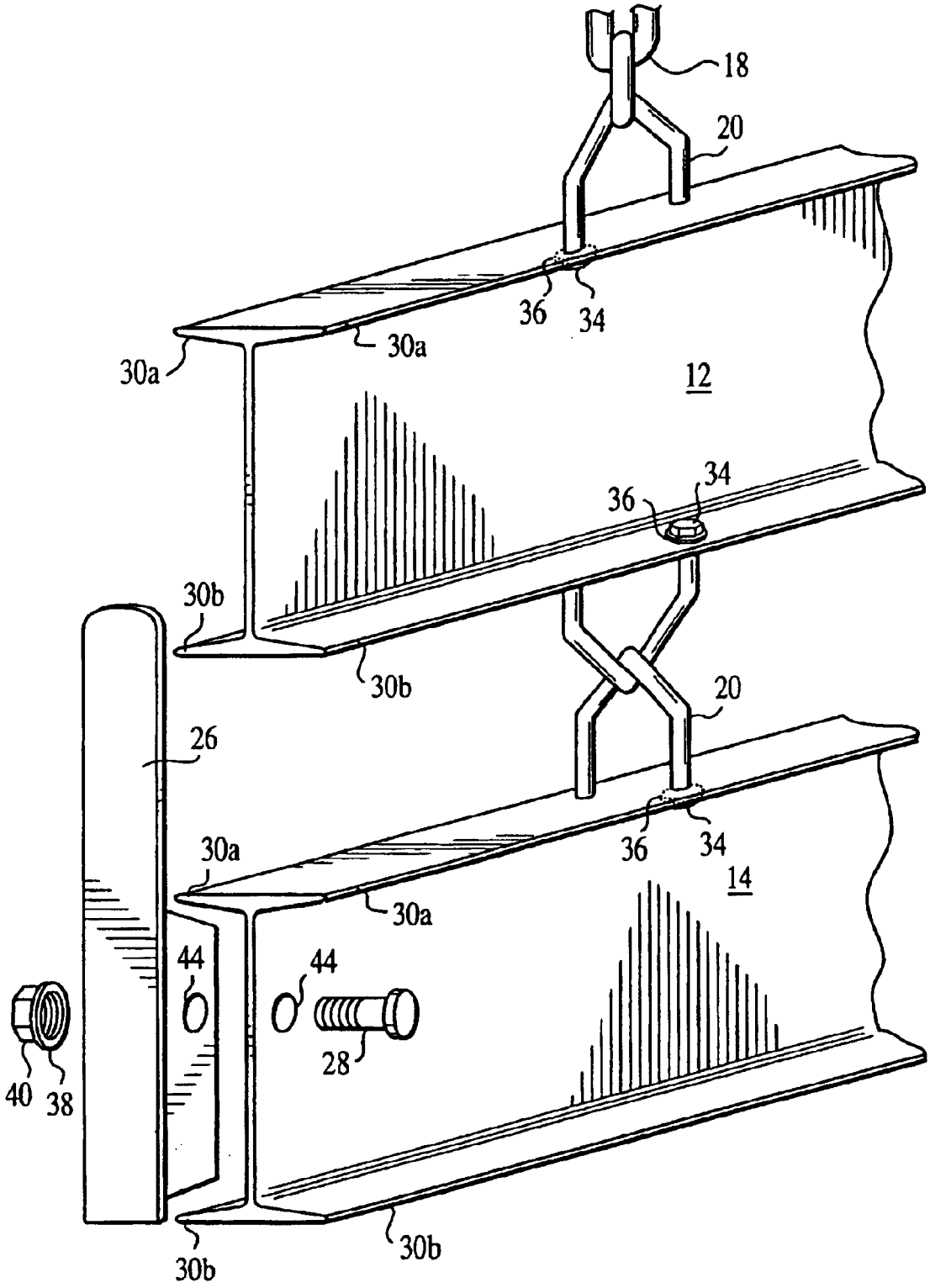
FIG. 4 illustrates the connection of a material guard to the grader in one embodiment.
Figure 5:
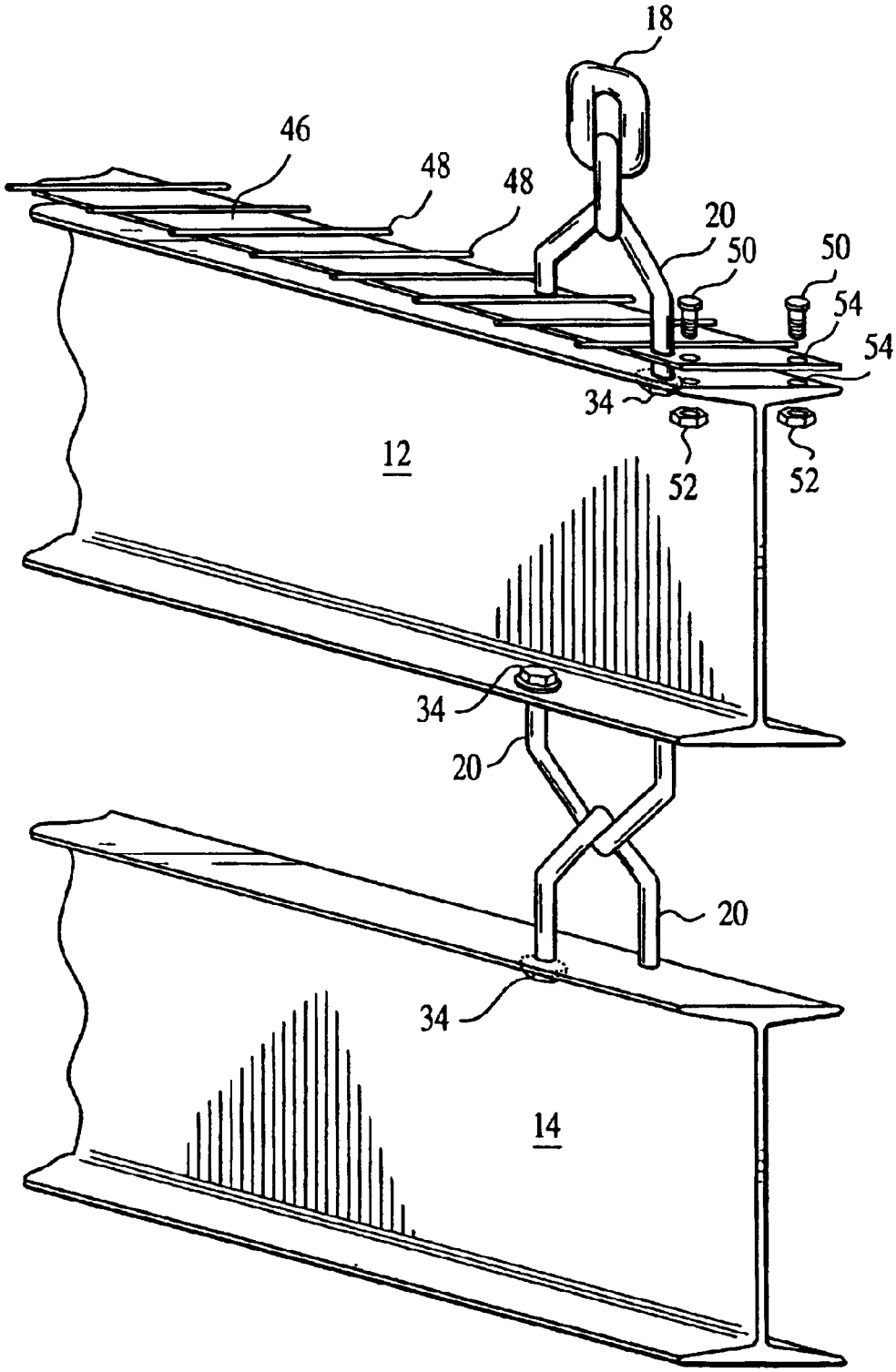
FIG. 5 illustrates another embodiment of the grader having an optional brush rake attachment.

One embodiment of the grader 10 includes a first horizontally elongate beam 12 and a second horizontally elongate beam 14, each having a first and a second side, and each side adapted to engage, spread and smooth the material. As shown in FIGS. 1, 4, and 5, the elongate beams 12 and 14 may be metals beams, such as those fabricated from steel, iron, aluminum, and similar materials. The beams 12 and 14 may have a cross-sectional shape in the form of an I, such as commercially available steel I-beams commonly used in the construction industry. Both of the beams 12 and 14 preferably have two sides for engaging the ground and the material to spread and smooth the material. As illustrated in FIG. 4, when the beams 12 and 14 are in the shape of an I-beam, each side of the beams 12 and 14 have two ground-engaging edges 30*a* and 30*b*. In this embodiment, the beams 12 and 14 have a channel on each side formed between the ground-engaging edges 30*a* and 30*b*, which at least temporarily may hold the material during use of the grader 10. Material may also be carried temporarily between the first and second beams. Although only two elongate beams are illustrated in the drawings, one skilled in the art will appreciate that three or more beams may be incorporated into the present invention to extend the reach of the grader 10 as well as increase the drag. The third or more beams may be attached to second beam 14 in the same manner as the first beam 12 is attached to the second beam 14, as described below. The third beam may be longer than the second beam 14.

Figure 2:
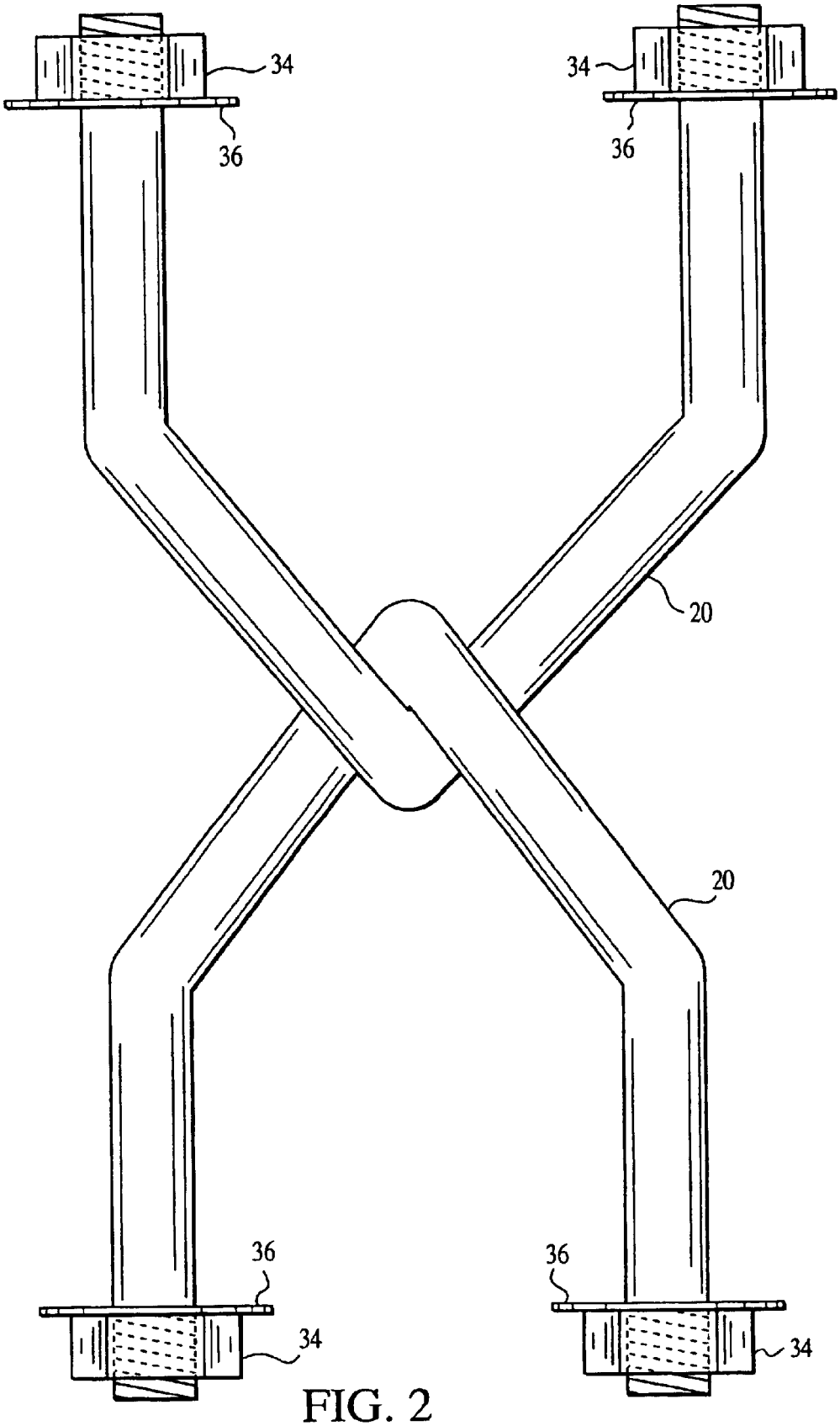
FIG. 2 illustrates linkage bolts used in one embodiment of the invention for coupling the elongated beams of the grader.
Figure 3:
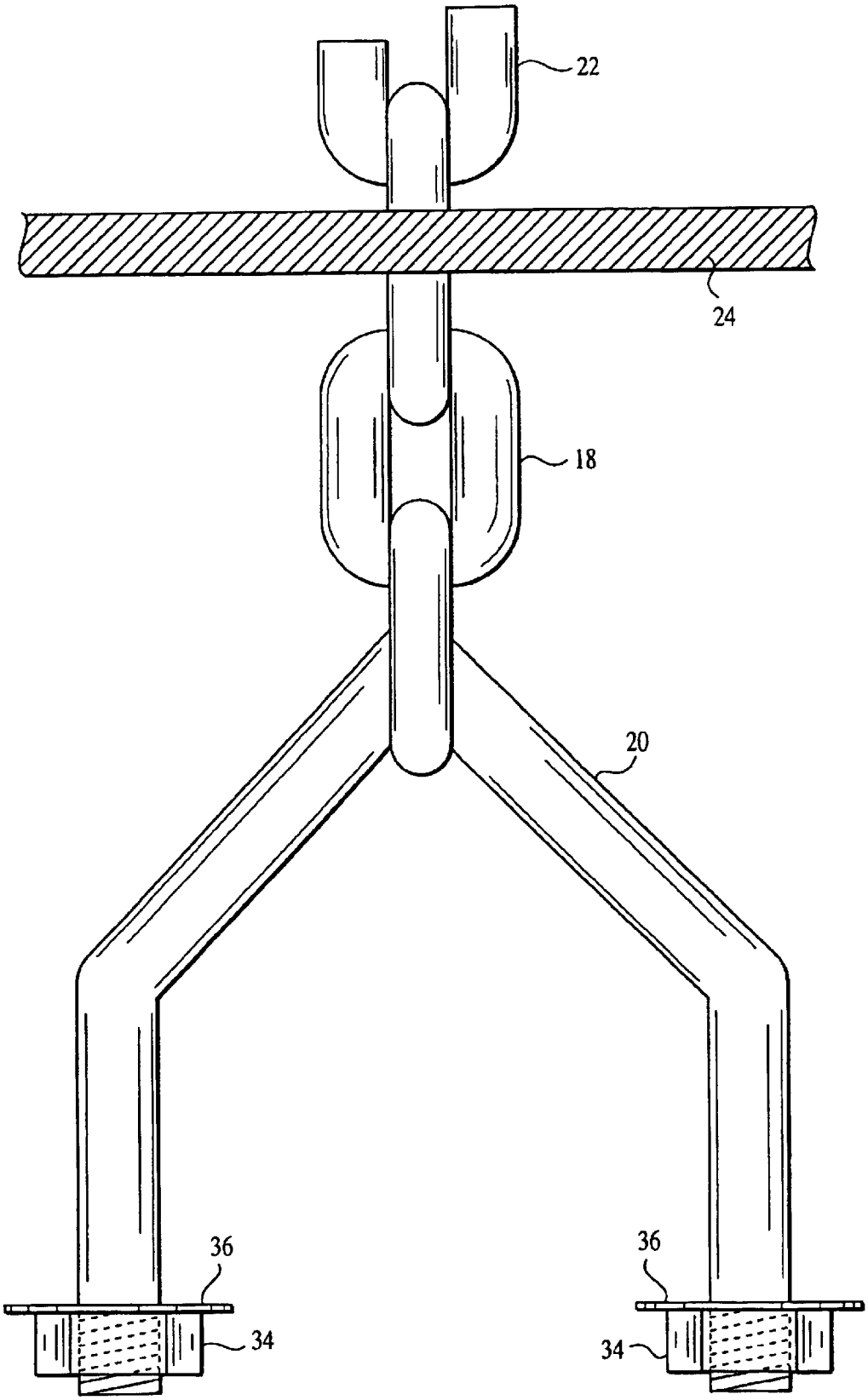
FIG. 3 illustrates the linkage assembly of the grader.

As illustrated in detail in FIG. 2, the second beam 14 may be coupled to the first beam 12 using a series of linkage bolts 20, linkage washers 36, and linkage nuts 34. The linkage bolts 20 extend though pre-drilled apertures in the beams 12 and 14. There may be more than two combinations of the linkage bolts to provide connection and support at more than two locations along the length of the beams. As illustrated in detail in FIG. 3, the first beam 12 may be releasably attached to the cutting edge 24 of the lift unit 16 using a linkage assembly that includes one or more subassemblies, each subassembly including a linkage bolt 20 attached to the first beam 12 using a bolt 34, a tug chain 18 attached to the linkage bolt 20, and a key bolt 22 attaching the tug chain 18 to the lift unit 16 of the material handling vehicle. Use of the linkage bolts 20, also commonly referred to as V-bolts, to couple the first beam 12 to the second beam 14 provides stability to the grader 10. The V-bolt allows the second beam 14 to exert pressure on the first beam 12.

As illustrated in FIGS. 1 and 4, a material guard 26 may be attached to each end of the second beam 14 to assist in keeping the material generally contained as the grader is drug across the material. Preferably, the material guard 26 projects in a direction toward the first beam 12. The material guard 26 is attached to the second beam 14 using a connection bolt 28 passing through apertures in the second beam 14 and a flange 42 of the guard 26 and secured using a washer 38 and a nut 40. The second horizontally elongate beam 14 may be longer in length than the first horizontally elongate beam 12 to assist the material guard 26 in retaining the material in the vicinity of the beams.

Figure 6:
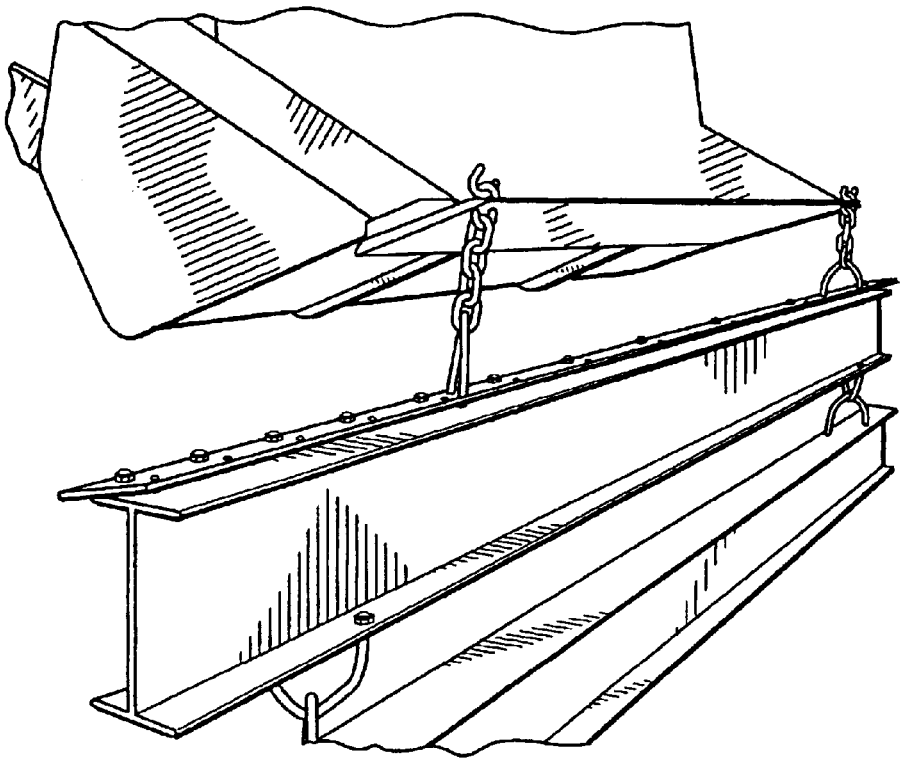
FIG. 6 illustrates another embodiment of the grader having an optional snow removal attachment.

FIG. 5 illustrates a brush rake 46 that may be optionally attached to the first beam 12 to assist in breaking up the material into smaller particles. The brush rake 46 may include a number of rigid rods 48 and may be attached to the first beam 12 using one or more bolts 50 passing through apertures 54 in the rake 46 and beam 12 and secured using nuts 52. The grader 10 may also be used for snow removal and may include specially designed attachments for such purposes. One such attachment may include a rectangular piece of material attached to the first beam 12 that is slightly larger in both width and length, as illustrated in FIG. 6.

Figure 7:
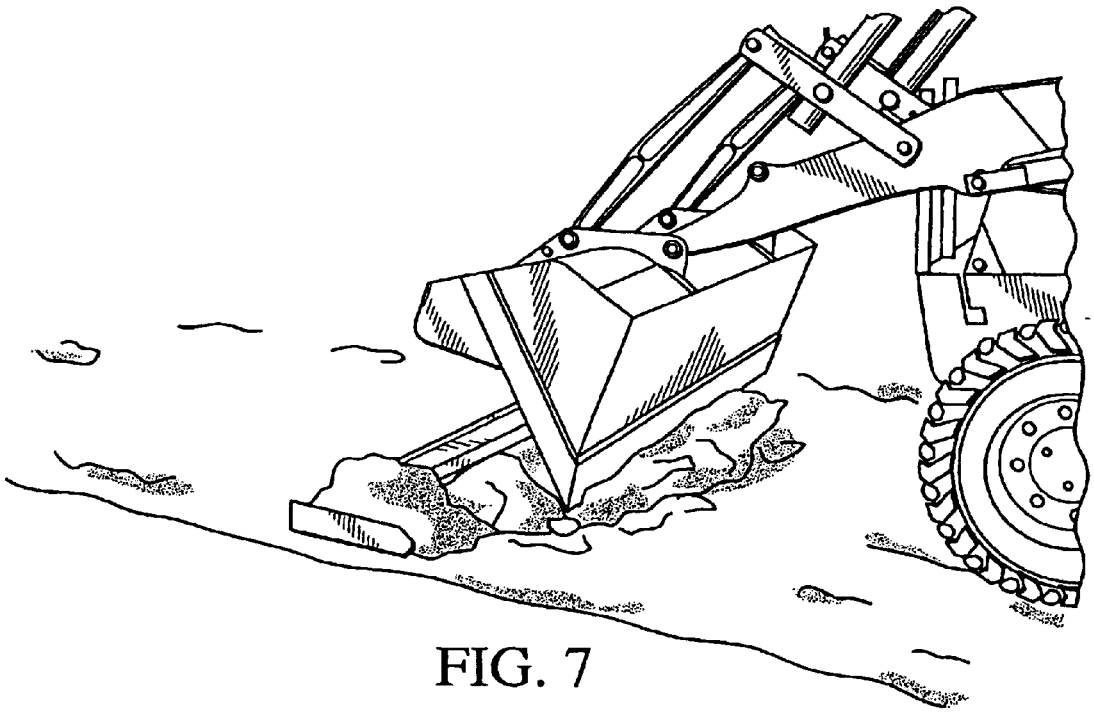
FIG. 7 illustrates an embodiment of the grader attached to a front end loader for use in being pulled in a first direction.
Figure 8:
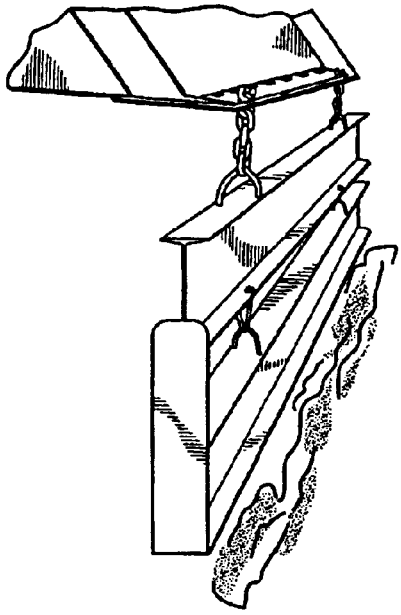
FIG. 8 illustrates the grader of FIG. 6 being flipped over as attached to a front end loader.
Figure 9:
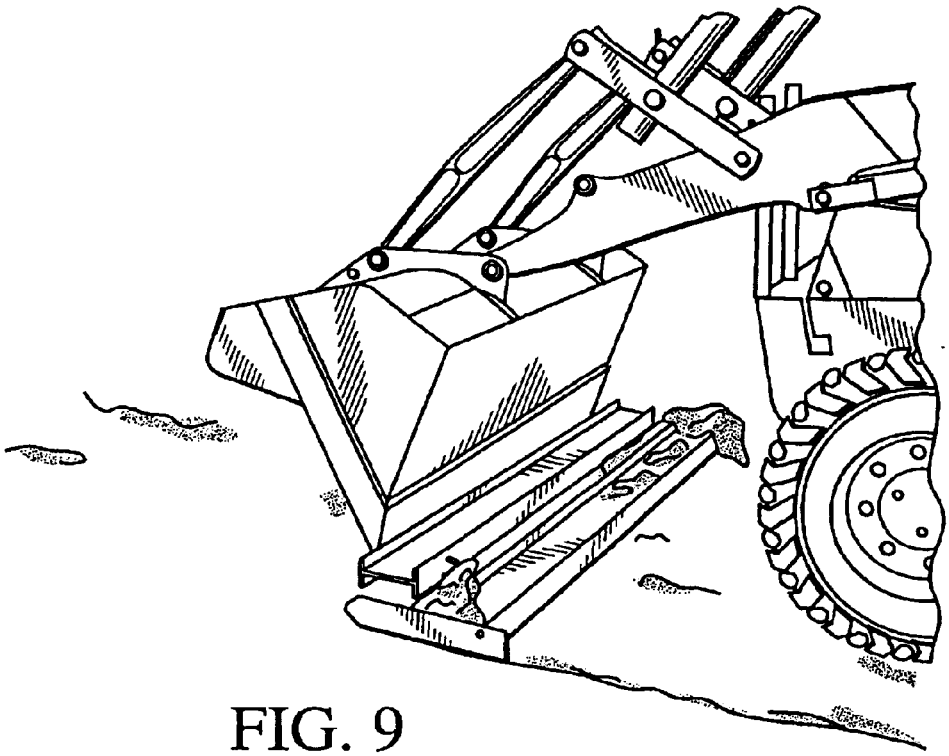
FIG. 9 illustrates the grader of FIG. 6 being pulled in a second direction.

Having described the various configurations for the grader 10, its operation use may now be described. After the grader 10 is attached to the lift unit 16 of a material handling vehicle, the grader 10 may be drug across material to be spread in a first direction. For example, as illustrated in FIG. 7, this first direction may entail the front end loader traveling east with a lift unit 16 (here, a loader bucket) attached to the back of the front end loader. The grader 10 follows the loader bucket and selectively engages the material. With the loader bucket in the lowered position, the cutting edge 24 of the loader bucket engages the material or ground first, followed by the two ground-engaging edges 30*a* and 30*b* of the first beam 12, and then the two ground-engaging edges 30*a* and 30*b* of the second beam 14. Because of the relatively short linkage between the loader bucket and the first beam 12, the loader bucket places downward pressure on the first beam 12. As the grader 10 passes across the particular material, some of the material may temporarily gather within the channels of the beams 12 and 14, and/or between the beams, to assist in spreading and smoothing out the material. The material guards 26 that may be attached to the second beam 14 may further assist in this process. After a first pass across the material, as illustrated in FIG. 8, the loader bucket may be raised and the material handling vehicle maneuvered in a fashion to allow the grader 10 to pivot and swing toward the material handling vehicle such that the grader 10 is flipped over and is positioned between the material handling vehicle and its loader bucket. In this second position, the second sides of the beams 12 and 14 are now facing and engaging the material. As illustrated in FIG. 9, the material handling vehicle may now travel to the west such that the opening of the loader bucket faces forward to again allow the cutting edge 24 of the loader bucket to engage the material or ground first, followed by the two ground-engaging edges 30*a* and 30*b* of the second side of the first beam 12, and then the two ground-engaging edges 30*a* and 30*b* of the second beam 14. In this direction, the loader bucket is ahead of the vehicle. Thus, the grader 10 may pivot or swing to flip the grader 10 over for grading in the opposite direction without the need for the material handling vehicle to be turned around. This is particularly useful in small or narrow locations where it may be difficult or impossible to turn the vehicle around. When using the grader 10 in the manner shown in FIGS. 7–9, the cutting edge 24 of the loader bucket can be used to cut a ridge into compacted dirt, while the loosened dirt piles up within the channel of the first beam 12 to be spread in a different location. As the front end loader moves along, the material falls off the first beam 12 and the second beam 14 further spreads and smoothes the material.

Figure 10:
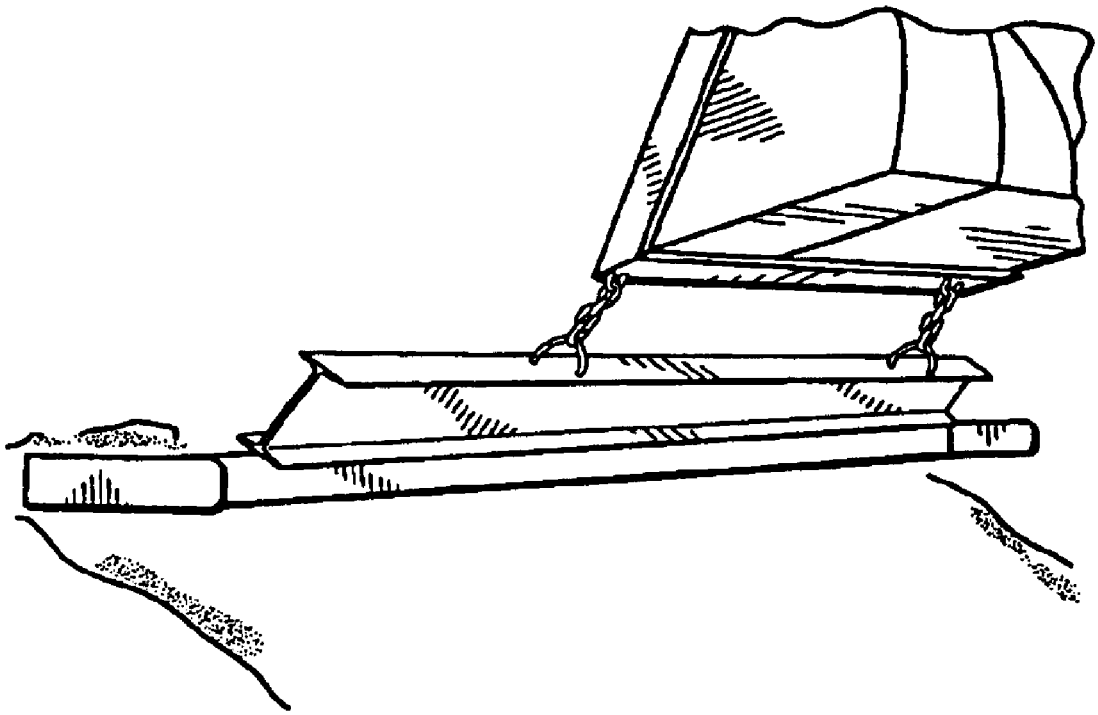
FIG. 10 illustrates the grader being raised by a front end loader.

FIG. 10 illustrates that the grader 10 may be raised and lowered in conjunction with the lift unit 16. For the embodiment of the grader shown in FIGS. 1–4, in which steel I-beams are used, this allows none or any number of the ground-engaging edges 30*a* and 30*b* of the first and second beams 12 and 14 to engage the ground and/or material. Thus, as the lift unit 16 is raised, the forward ground-engaging edge 30*a* of the first beam 12 is lifted off the ground, followed in succession by the rear ground-engaging edge 30*b* of the first beam 12, the forward edge 30*a* of the second beam 14, and eventually the rear edge 30*b* of the second beam 14. As the grader 10 is lifted, material carried between or on the beams may be deposited as desired. As the grader 10 is positioned with the first beam 12 lifted off the ground and the second beam 14 engaging the ground, the first beam 12 assist in weighing down the second beam 14 to add stability to the grader 10. A weight bar may also be attached to one of the beams, such as the second beam 14 to further stabilize the grader 10 during use. The beams of the grader 10 of the present invention have the ability to stay flat on the earth even if the material handling vehicle to which the grader 10 is attached is rocking. This results from both the usage of the second beam 14, the linkage bolt 20 in the form of a V-bolt, and the connection between the first beam 12 and the lift unit 16. The tug chain 18 that is used to attach the first beam 12 to the lift unit 16 allows a significant amount of slack between the first beam 12 and the lift unit 16. This feature, coupled with the pressure exerted by the second beam 14 and its V-bolt connection, provides an important advantage of the grader 10. Furthermore, the use of a grader 10 that is closely connected to the cutting edge of the lift unit 16 (as opposed to a grader that may be attached to the back of a tractor) allows for greater precision in use, particularly when used around curves.

Passage of the grader 10 over particulate material in the manner described herein has the effect of distributing, spreading, leveling and smoothing particular material such that the surface left in the wake is relatively level and flat.

The grader may also be used in other applications, including scraping, tamping, grading, and other movements of the earth and materials.

Although the present invention has been described in considerable detail with reference to certain presently preferred embodiments thereof, other embodiments are possible without departing from the spirit and scope of the present invention. Therefore the appended claims should not be limited to the description of the preferred versions contained herein.

I claim:

1. A grader for spreading and smoothing material, the grader adapted to be attached to a lift unit of a material handling vehicle, the grader comprising:

a first horizontally elongate beam comprising a first and a second side, the first beam adapted to engage, spread and smooth the material;

a second horizontally elongate beam coupled to the first horizontally elongate beam and having a length greater than the length of the first beam, the second horizontally elongate beam comprising a first and a second side which correspond in orientation to the first and second side of the first beam, the second beam adapted to further engage, spread and smooth the material;

a linkage assembly for releasably attaching the first beam to the lift unit of the material handling vehicle and for allowing the lift unit to exert downward pressure on the first beam;

wherein the grader is adapted to be pulled in a first direction wherein the lift unit of the material handling vehicle may engage the material first, followed by the first beam and then followed by the second beam, wherein as the grader is pulled in the first direction the first sides of the elongate beams face the material; and wherein the grader is adapted to be flipped over and pulled in a second direction wherein the lift unit of the material handling vehicle may engage the material first, followed by the first beam and then followed by the second beam, wherein as the grader is pulled in the second direction the second sides of the elongate beams face the material.

2. The grader of claim 1 wherein the first and the second sides of the first and second beam each have at least two ground-engaging edges.

3. The grader of claim 2 wherein the lift unit of the material handling vehicle may be controllably raised and lowered, thereby controllably raising and lowering the grader such that none or any number of the ground-engaging edges of the first and second beam may engage the material.

4. The grader of claim 3 wherein the second beam weighs down the first beam when first beam is raised off of the material to add stability to the grader.

5. The grader of claim 2 further comprising at least one channel between the ground-engaging edges to at least temporarily hold the material during use of the grader.

6. The grader of claim 1 wherein the second beam is coupled to the first beam with a plurality of linkage bolts.

7. The grader of claim 6 wherein each linkage bolt comprises a V-bolt.

8. The grader of claim 1 wherein the first and second beams comprise steel I-beams.

9. The grader of claim 1 further comprising a material guard attached to each end of the second beam to assist in keeping the material generally contained, the material guard projecting in a direction toward the first beam.

10. The grader of claim 1 wherein the linkage assembly comprises one or more subassemblies, each subassembly comprising a linkage bolt attached to the first beam, a tug chain attached to the linkage bolt, and a key bolt attaching the tug chain to the lift unit of the material handling vehicle.

11. The grader of claim 1 further comprising a weight bar attached to the first beam.

12. The grader of claim 1 further comprising a brush rake attached to the first beam.

13. The grader of claim 1 further comprising a snow removal attachment.

* * * * *